United States Patent [19]

Illuminati

[11] Patent Number: 4,759,532

[45] Date of Patent: Jul. 26, 1988

[54] LANCE FOR INJECTING HIGHLY-LOADED COAL SLURRIES INTO THE BLAST FURNACE

[75] Inventor: Duilio Illuminati, Statte, Italy

[73] Assignee: Nuova Italsider SpA, Genoa, Italy

[21] Appl. No.: 936,650

[22] Filed: Dec. 1, 1986

[30] Foreign Application Priority Data

Nov. 29, 1985 [IT] Italy ..... 48842 A85

[51] Int. Cl.[4] ..... C21B 7/16

[52] U.S. Cl. ..... 266/182; 75/42; 266/267

[58] Field of Search ..... 266/182, 188, 267; 75/42

[56] References Cited

U.S. PATENT DOCUMENTS 3,197,305 7/1965 Carlson ..... 266/188

3,937,449 2/1976 Copeland et al. ..... 266/188

*Primary Examiner*—Melvyn J. Andrews

*Attorney, Agent, or Firm*—Young & Thompson

[57] ABSTRACT

In the environment of a blast furnace having a tuyere protruding inwardly from its inner wall and fed by a blow pipe, a lance extends through a side wall of the blow pipe for injecting coal-water or coal-tar mixtures or any other highly-loaded coal slurry through a central conduit surrounded by an outer conduit for air under pressure that cools the lance and atomizes the fuel carried by the inner conduit. The inner conduit terminates no farther into the blow pipe than the inner wall of the blow pipe, so that the hot air passing through the blow pipe does not heat the inner conduit and clog it. The outer conduit terminates on the axis of the blow pipe at about the connection between the tuyere and the blow pipe.

4 Claims, 1 Drawing Sheet

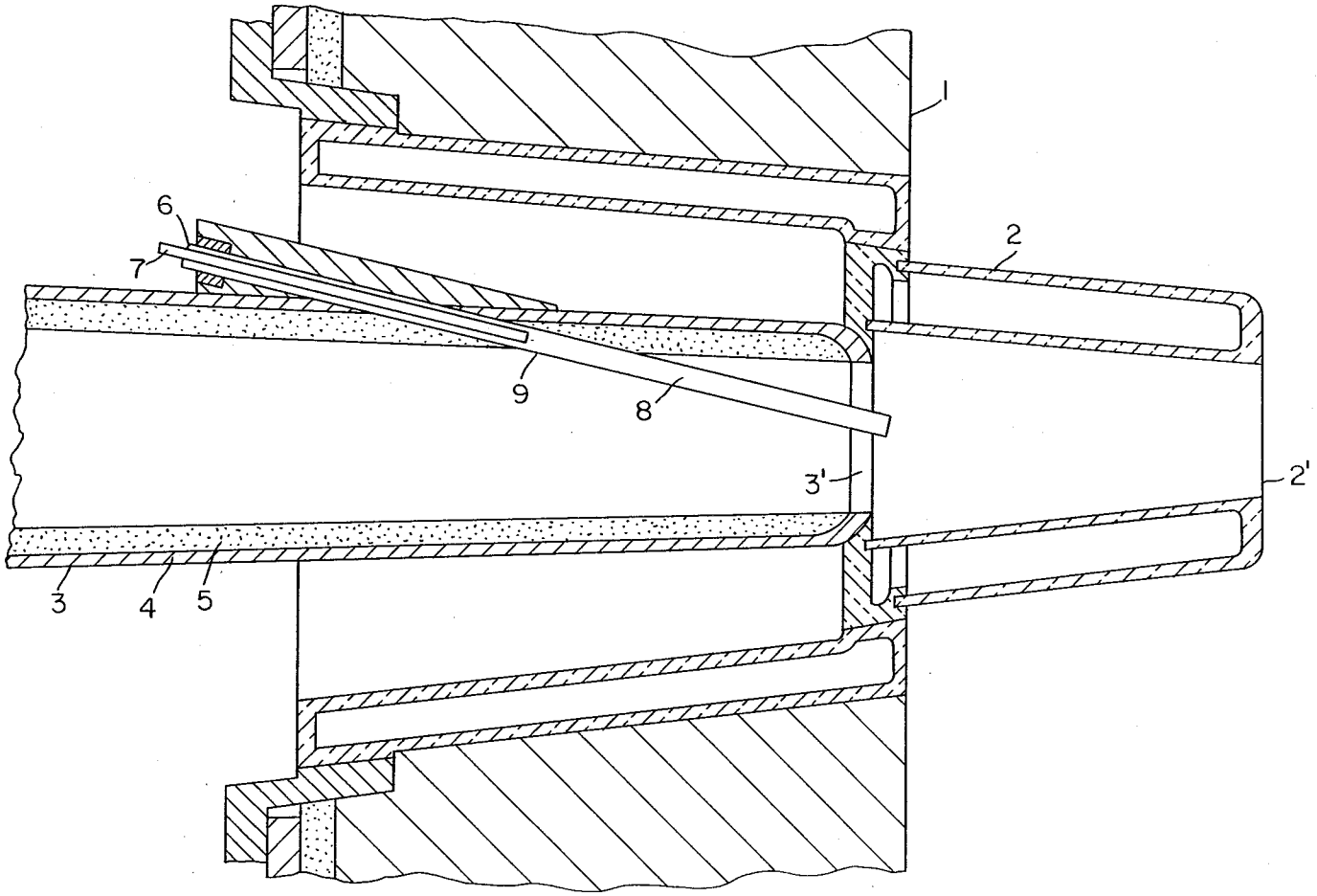
1
2
2'
3'
8
9
6
7
5
4
3

LANCE FOR INJECTING HIGHLY-LOADED COAL SLURRIES INTO THE BLAST FURNACE

The present invention refers to a lance for injecting highly-loaded coal slurries into the blast furnace; more precisely, it concerns a new simplified lance design which permits using highly-loaded coal-water or coal-tar mixtures as blast furnace auxiliary fuels.

Owing to the sharp rise in the price of petroleum products, vigorous efforts have been made in many sectors of industry to find other fuels which are equally suitable and economically advantageous.

In the case of blast furnace operation, for example, the technique of injecting fuel oil into the tuyeres was originally developed as a means for achieving high performance levels and, at the same time, an even furnace operation. This technique became less attractive from the economic standpoint with the rising cost of fuel oil, especially as the iron and steel industry was concurrently hit by an overproduction crisis of worldwide proportions. It was therefore proposed to replace fuel oil with other fuels (such as coal-water and coal-tar mixtures) which possess a high heat value and cost less. Since the two types of mixture can be considered identical for the purposes of the present invention, reference is made here solely to coal-water (CW) mixtures with the implicit understanding that the same considerations apply equally to coal-tar mixtures.

Coal is the most important constituent of the two mixtures and must therefore always be present in the highest possible proportion. This requirement is essential when the slurries are used as blast furnace auxiliary fuel, since any lowering of the thermal efficiency of the mixture will prevent the desired technical-economic advantages being obtained and, in addition, may cause dangerous chilling and even damping down of the furnace, as was verified during some experimental productions. Coal-water mixtures have therefore been developed containing over 80% of coal which are excellent auxiliary blast furnace fuels, although they do raise serious problems of transport and physical stability.

Given the very high content of solids, even the slightest tendency on the part of the liquid to separate will cause the slurry rapidly to lose the properties of a fluid and also the necessary pumpability. Under these conditions, tanks and piping conveying the mixtures are very soon clogged by damp coal dust. It has however been ascertained that the viscosity of these mixtures can be kept at acceptable levels by adopting suitable preparation techniques and, especially, by using suitable additives.

Highly-loaded CW mixtures have in several instances been used experimentally as blast furnace auxiliary fuels obtaining, in some cases, very promising results. The difficulties associated with maintaining a steady delivery rate, however, have so far blocked or seriously impeded the widespread use of these mixtures at industrial level. It has been repeatedly observed, in fact, that the lances currently used for injecting CW mixtures in the tuyeres clog after only a few hours, upsetting furnace control and the necessary continuity of operation. These lances are designed along the general lines of an oil burner and consist of a barrel with internal conduit (through which the CW mixture is pumped) and with, at the delivery end, a hollow helical nozzle which imparts a swirling motion to the mixture so that a fine spray is issued. A second conduit, coaxial to the first and surrounding it, delivers the compressed air which atomizes the mixture and propels it into the tuyere. The outer conduit delivering the air is terminated shortly before the delivery end of the conduit conveying the CW mixture. This arrangement prevents the mixture from burning in the air conduit without impairing nozzle efficiency; it is also necessary because the terminal portion of the lance is inserted into the tuyere which carries blast air at the average temperature of approximately 1200° C.

Under these conditions, it has been established experimentally that CW mixtures have to be injected at high flow rates, since the lances currently in use start to clog at 800 liters per hour. However, for smooth efficient operation of the blast furnace, the injection rate should be kept at a lower level, that is around 300–400 liters per hour.

Cooled and/or insulated lances have been proposed in order to meet these contrasting requirements, but these improvements did not give the desired results.

To sum up, none of the lances currently available for injecting highly-loaded CW mixtures into the blast furnace tuyeres is capable of operating at low injection rates uninterruptedly for protracted periods of time.

The aim of the present invention is to meet this requirement by providing a lance of simple design which prevents the formation of internal obstructions and which therefore is capable of injecting highly-loaded CW mixtures into high temperatures environments at a steady constant rate.

The present invention is based on the finding that the lances currently used for injecting fuel oil into blast furnace tuyeres and those proposed up to now for similar injection of highly-loaded CW mixtures are all designed according to the principles of operation of an oil burner. In other words, they are all provided with a terminal nozzle through which a high-pressure airstream propels the fuel out of the lance so as to obtain an air-fuel mixture which will burn with a flame of given shape and dimensions.

In effect, these arrangements are not strictly necessary in the case of blast furnace auxiliary fuels; above all, it should not be necessary to eject a specific air/fuel mixture since the high-speed, high-temperature turbulent airstream blown in through the tuyere ensures complete combustion irrespective of the proportion of the mixture. There is however the requirement that the auxiliary fuel injected by the lance must not ignite within the tuyere, or too far out from the nose of the tuyere.

These varied requirements have all contributed to slowing down the use of highly-loaded CW mixtures, which is indeed still at the experimental stage for other reasons.

According to the present invention, the lance for injecting coal-water or coal-tar mixtures (or any other highly-loaded coal slurry) into blast furnace tuyeres is characterized by the fact that the inner conduit delivering the fuel is far shorter than the outer conduit delivering the gas; with this arrangement an expansion and mixing chamber is formed in the terminal portion of the lance. The inner conduit should preferably end level with the hole through which the lance enters the blowpipe, while the terminal end of the lance should be positioned at the centre of the blowpipe and level with the connection between blowpipe and tuyere.

The terminal end of the outer conduit is fitted with a device that fans out the jet of coal and water exiting from the lance. The stretch of outer conduit between the terminal end of the lance and the terminal end of the inner conduit forms a chamber in which the highly-loaded CW mixture streaming from the inner conduit is split up and dispersed by the gas conveyed through the outer conduit. At the same time, the water content of the mixture vaporizes in the chamber, generating additional pressure (which helps to propel coal out of the lance) and contributing to the cooling of the lance.

The invention will now be described in greater detail with reference to the application shown, purely as a non-limitative example, in the attached drawing which reproduces the section of the blast furnace wall associated with the invention.

The water-cooled copper casting (2), known as a tuyere, is mounted so as to protrude from the inner face of the furnace wall (1). The hot blast air which is blown into the furnace by the tuyere is carried to the tuyere by the blowpipe (3) consisting of a steel pipe (4) lined with refractory material (5).

The lance (9) enters through an opening in the side of the blowpipe (3) and consists of an outer conduit (6), which conveys air under pressure that is used for cooling the lance and for atomizing the fuel carried by an inner conduit; said inner conduit (7) is shorter than the outer conduit (6) in such a way that the terminal portion of the lance forms a chamber (8) for the expansion and atomization of the fuel.

The inner conduit (7) should preferably end level with the refractory lining (5) of the blowpipe so that the hot air blast in the blowpipe (3) will not affect conduit (7) or, at most, will affect only a limited stretch of it.

When the lance is operated, a specified constant flow of coal-water, coal-tar or other highly-loaded coal slurries is delivered by the inner conduit (7) into the chamber (8), where it is dispersed by the gas blown through the outer conduit (6). At the same time, the water contained in the mixture vaporizes (with beneficial cooling effects) and the steam generated enhances the dispersion and mobility of the coal particles. In this way, the coal particles no longer agglomerate as is the case in other types of lances.

The coal dust jet is delivered by the lance centrally, in front of the end (3') of the blowpipe and just beyond the connection between blowpipe and tuyere.

The hot air blast streaming into the tuyere at subsonic speed further disperses the coal particles and carries them out of the nose (2') of the tuyere, where they ignite and burn.

What is claimed is:

1. In combination with a blast furnace having an inner wall and having a tuyere connected to and protruding inwardly from said inner wall and connected to a blow pipe having an inner side wall for feeding gas to the tuyere, a lance that extends through said inner side wall of the blow pipe and comprises an inner conduit for a highly-loaded coal slurry and an outer conduit surrounding the inner conduit for gas that cools the lance and atomizes the slurry carried by the inner conduit, the outer conduit extending beyond the inner conduit a substantial distance into the blow pipe and the inner conduit extending no farther into the blow pipe than said inner side wall of the blow pipe.

2. Apparatus as claimed in claim 1, in which the inner conduit terminates about level with said side wall of the blow pipe.

3. Apparatus as claimed in claim 2, in which said outer conduit terminates on a longitudinal axis of said tuyere at about where the blow pipe connects to the tuyere.

4. Apparatus as claimed in claim 1, in which said outer conduit terminates on a longitudinal axis of said tuyere at about where the blow pipe connects to the tuyere.

* * * * *